United States Patent [19]

Larsen

[11] 4,154,550

[45] May 15, 1979

[54] SYSTEM FOR DEPOSITING AND PROTECTING SEDIMENT ON THE FLOOR OF A BODY OF WATER AND A METHOD OF INSTALLING IT

[76] Inventor: Ole F. Larsen, P.O. Box 604, 6700 Esbjerg, Denmark

[21] Appl. No.: 807,527

[22] Filed: Jun. 17, 1977

[30] Foreign Application Priority Data

Jun. 28, 1976 [GB] United Kingdom ..... 26748/76

[51] Int. Cl.[2] ..... E02B 3/00; E02B 3/18

[52] U.S. Cl. ..... 405/74; 405/20

[58] Field of Search ..... 61/2, 3, 4, 37, 38

[56] References Cited

U.S. PATENT DOCUMENTS

| | | | |
|---|---|---|---|
| 1,816,095 | 7/1931 | Stanford | 61/3 |
| 2,069,715 | 2/1937 | Arpin | 61/4 |
| 2,466,343 | 4/1949 | Weber | 61/4 |
| 3,875,750 | 4/1975 | Campbell | 61/4 |
| 3,888,209 | 6/1975 | Boots | 61/3 |

*Primary Examiner*—Jacob Shapiro

*Attorney, Agent, or Firm*—Diller, Ramik & Wight

[57] ABSTRACT

This invention is directed to a system for depositing and protecting sediment on the floor of a body of water by means of an elongated plate-like structure which includes a pair of opposite longitudinally extending side portions and a center portion therebetween with upper surfaces of the longitudinally extending side portions being in diverging relationship to each other in a direction toward the floor of a body of water, and means are provided for at least partially overlying the longitudinally extending side portions and projecting laterally therebeyond for protecting the same from damage due to dragging ship's anchors, fishing gear, and the like.

23 Claims, 20 Drawing Figures

SYSTEM FOR DEPOSITING AND PROTECTING SEDIMENT ON THE FLOOR OF A BODY OF WATER AND A METHOD OF INSTALLING IT

The invention relates to a system for depositing and protecting sediment on the floor of a body of water, with the purposes of protection of underwater pipelines and cables, shore protection, prevention of shoaling up of waterways, etc.

The present invention features in particular measures for protection from damages due to dragging ships' anchors and fishing gear, and also a rational method of installing the system.

Figure 2:
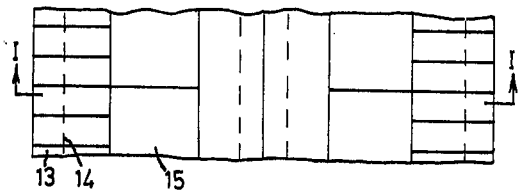
Figure 4:
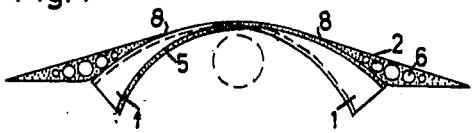
Figure 3:
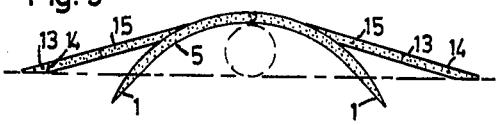
Figure 5:
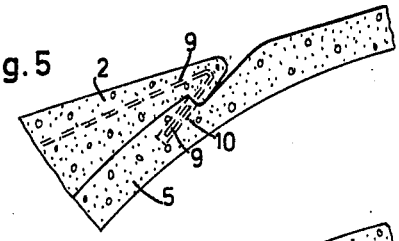
Figure 7:
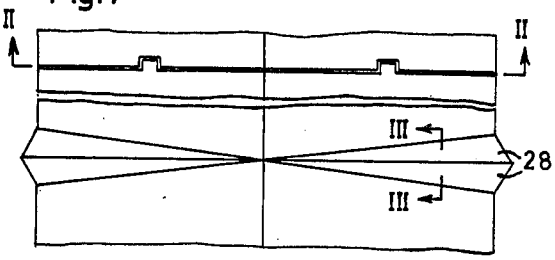
Figure 6:
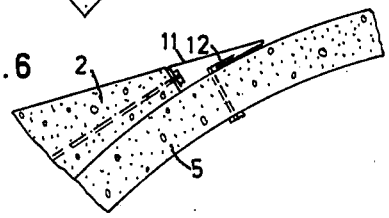
Figure 9:
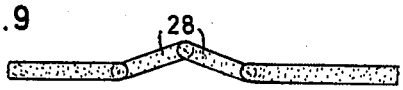
Figure 8:
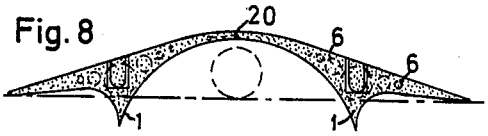
Figure 10:
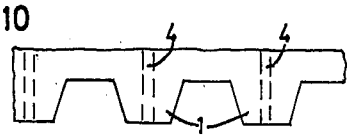
Figure 13:
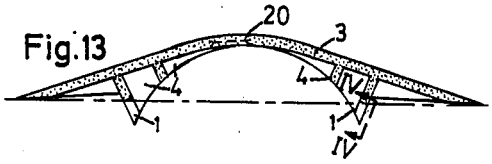
Figure 11:
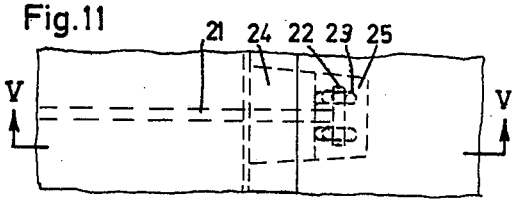
Figure 14:
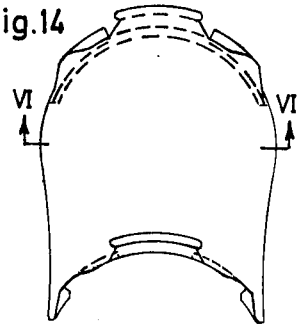
Figure 12:
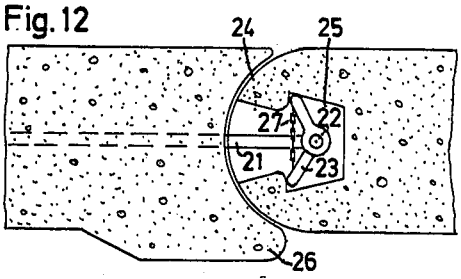
Figure 15:
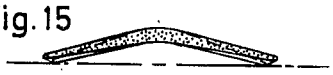
Figure 1:
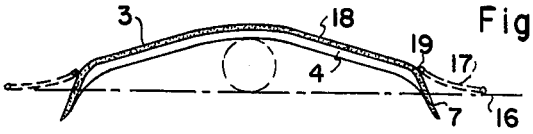

In the following detailed description of the invention reference will be made to the drawing, in which FIG. 1 is a cross-section of a protective cover, FIG. 2 plan view of an alternative cover, FIG. 3 is a cross-section taken along the line I—I of FIG. 2;

FIG. 4 a cross-section of a cover with separate loose edge portions,

FIGS. 5 and 6 cross-sections of alternative designs of the connection 8 in FIG. 4, on enlarged scale, FIG. 7 plan view of a cover containing channels 6, FIG. 8 a cross-section taken along the line II—II of FIG. 7, FIG. 9 a cross-section of enlarged scale, taken along the line III—III of FIG. 7, FIG. 10 an enlarged longitudinal section of the lower edge of a skirt, taken along the line IV-IV of FIG. 13, FIG. 11 plan view of a special hinged connection, FIG. 12 a cross-section along the line V—V of FIG. 11, FIG. 13 a cross-section of a cover strengthened by ribs, FIG. 14 plan view of a cover with circular ends, FIG. 15 a cross-section taken along the line VI-VI of FIG. 14.

Figure 16:
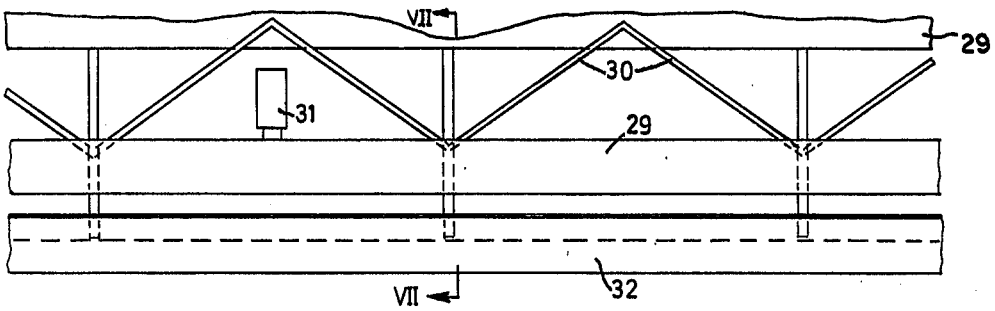
Figure 17:
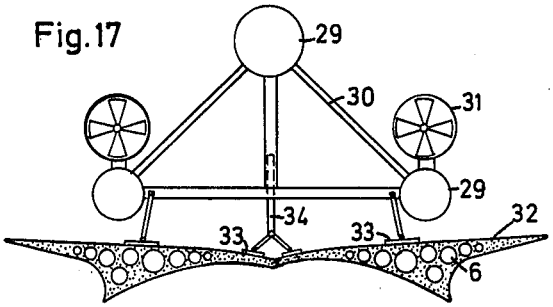
Figure 18:
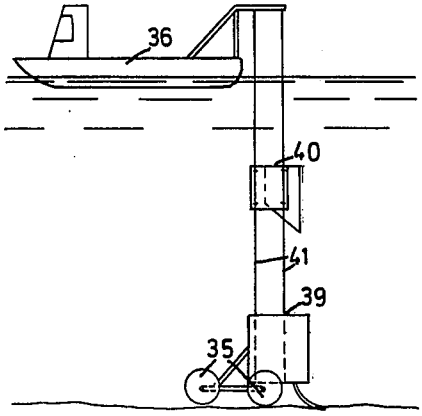
Figure 19:
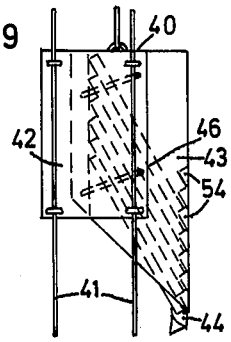
Figure 20:
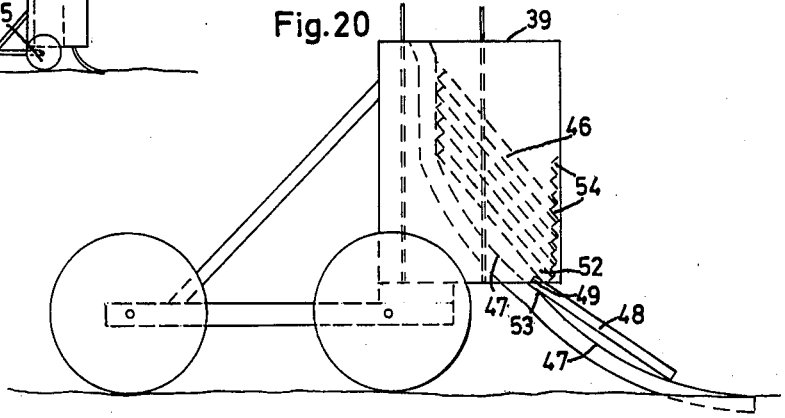

FIG. 16 a side view of a special underwater vehicle carrying a cover,

FIG. 17 is cross-section taken along the line VII—VII of FIG. 16,

FIG. 18 a side view of an underwater vehicle supported on the seabed and connected with a surface vessel, and FIG. 19 and 20 are enlarged side views of details of FIG. 18.

The cover may be designed to acquire the necessary strength without use of too much material for fabrication and consequently too heavy weight of the cover.

As shown in FIG. 4, the portion 1, or any other portion, may consist of a thin plate, if it is corrugated. The cross-section of the corrugation may be sinuous, trapezoidal, saw-toothed, etc.

Flow through openings made with this purpose or slits in connections such as 8 (FIG. 4) will cause the open space of the corrugation between the edge portion 2 and the lower portion 5 to be filled with sediment. Alternatively, one or more portions may be filled with hollows 6 (FIGS. 4, 7, 8). Or a thin surface plate 3 (FIGS. 1, 13) may be strengthened by ribs 4.

Preferably the cover is supplied with one or more skirts 1 on either side of the centerline of the cover (FIGS. 3, 4, 8, 13). If the cover is divided in symmetrical halves hinged together along the ridge (FIGS. 2, 3, 4, 7, 8, 16), the center of gravity of either half should lie over or outside the supporting skirt, so that maximum stability is obtained. If the cover protects a pipeline, thereby only negligible weight from the cover is transferred to the pipeline, even if initial settlement of the cover takes place.

Prevention of damage due to dragging ships' anchors and trawlboards may be obtained in different ways. In the individual case the local conditions, i.e., bottom soil quality, depth of water, number and size of freighters, respectively trawlers, etc., determine which design should be used.

The cover shown in FIG. 1 ends at either side with a steep face 7 of such height that the flukes of an anchor crossing the cover cannot hook the lower edges of the cover. The width of the cover between the steep faces 7 should not be much narrower than the width of the normal cross-section without such steep faces. Otherwise the scour-preventing effect is lost.

As an extra protection against anchors and trawlboards the edge portions 2 of the cover may be separated from the slidably rest on the lower portion 5 (FIG. 4). Hanging from a line of open hinged connections 8, the loose edge portion 2, if hooked by an anchor, will slide across rest of the cover and thereby carry the anchor over, without damage to rest of the cover. The removed section of the edge portion is thereafter to be repositioned.

The connection 8 may be formed as shown in FIG. 5 or 6. In FIG. 5 the loose edge portion 2 is provided with bars 9 that fit into corresponding holes 10 in the lower portion 5. The bars 9 prevent 2 from raising from 5, but not from turning around the connection 8, or from sliding upwards, if 2 is hooked by an anchor.

In FIG. 6 the connection 8 is made of a thin, elastic plate, e.g. stainless stell, where 11 is an annular plate bolted to 2, and 12 the anchoring part mounted in 5.

Normally a dragging trawlboard will slip over without hooking the edge portion 2. To prevent unnecessary removal of 2, the connection 8 may be designed to resist removal of 2 by ess powerful impacts, so that only a hooking trawlboard or an anchor of a certain minimum size, but not a regularly moving vertical trawlboard can remove 2.

For example, the lowermost part of the bar 9 may be crooked or formed as a rawlplug, the surface between 2 and 5 in the connection 8 may be so uneven that a certain frictional resistance results, etc.

Alternatively the loose edge portion 13, FIG. 3, may be in pivotally hinged connection with rest of the cover, so that a hooling anchor would be lifted in a circle and land on one or the other side of the ridge.

A special arrangement, FIG. 2, includes a flexible border of pivotally hinged narrow pieces 13 that may be held together by a continuous wire 14. After having lifted the hooking anchor and left it on the cover, the piece lifting the anchor will be forced back to its original position by the wire 14 weighted by the neighbouring pieces 13. To further increase the flexibility, an extra width of interconnected larger pieces 15 may be included.

Another system for prevention of damage comprises longitudinally extending bars 16, FIG. 1, that are in pivotally hinged connection with the edge portions through cross-bars 17. A dragging anchor will hook the bar 16 and by the pivotal movement of this be lifted to land on the cover 18. The connection between 16 and 17 being weak in direction away from a pivotal hinge 19, the anchor will thereafter disrupt the connection and pass on without causing other damage.

If a device as shown in FIG. 8 or FIG. 13 is to protect a pipeline or the like, its units may either be so heavy that a dragging anchor will be held fast by the coherent assembly of heavy elements, so that the ship's officers would know that the anchor was foul and remedy the situation without damage to the pipeline. Or the hinge 20 may be designed so that it divides if the angle between the symmetrical halves decreases to a certain minimum. A dragging anchor powerful enough to remove one half of the cover therefore will slide across the pipeline on top of this half and be carried over the pipeline without hooking it.

An example of such hinge 20 is shown in FIGS. 11–12. One half of the cover includes at intervals bars 21 made for instance of stainless steel or aluminum. The end of each bar has a cross-piece 22 around which a clamp provided with pins 23 spread by spiral springs 27 or with elastic blades or spring coils 23 can rotate. The opposite half has a matching funnel-shaped hollow 24 ending with a wider hollow 25. By the joining of the two halves of the cover, the clamp 23 will be pressed together during its passage through the funnel 24, whereafter 23 will assume their original position in the hollow 25 and thereby prevent the two halves from parting. A thickened portion 26 forms a stop. Mutual rotation of the two halves beyond this stop results in breaking of the tie 27 or the pins or blades 23.

To ensure that the skirt 1 will sink into the bottom soil, so that the required resistance to horizontal forces can be obtained, its lower edge should be indented with a sawtoothed, sinuous, or other configuration, FIG. 10.

Depending on the seabed conditions (soil quality, surface regularity, etc.), each unit of the cover may be made very long, so that the number of joints of minimized and maximum resistability to dragging anchors is obtained.

In particular if shorter units are applied, the joints may be formed so as to smooth out any jumps between neighbouring units. In FIGS. 7 and 9 the two triangular transition pieces 28 are pivotally hinged to each other and to the adjacent units of cover. Forming an angle with each other when the two units are level, the surfaces of the transition pieces will straighten out and form a rather smooth transistion between the two units, if one of these settles deeper into the seabed than the other one.

Reduction of the weight of the cover may be obtained by means of hollows 6, FIGS. 4 and 8. By valving the channels 6, buoyancy can be utilized for minimizing the effective weight during the transport and installation of the cover and maximizing the weight afterwards.

For inspection of pipeline or other structure to be protected by the cover manholes closed by lids may be placed at suitable intervals in the cover.

For example for protection of cables or small diameter pipelines a design of the cover as shown in FIGS. 14–15 is appropriate. Its circular interlocking ends allow the row of interconnected blocks to follow any curve of the cable to be protected.

The upper surface of the block being corrugated crosswise, and the height of the waves of the corrugation gradually decreasing from the periphery toward the centerline, a hooking anchor will push the periphery downwards into the seabed, so that the block will turn over and carry the anchor over the cable or pipeline to be protected.

Installation of the cover constituting a substantial part of the total cost, a rational method of transporting and positioning the cover is important.

If the installation is to take place on the beach or in very shallow water, the cover is towed on the bottom.

In deeper water large covers should be transported near the seabed all the way from coast to installation site. The operation thereby is comparatively independent of weather conditions, and the number of working days per year increased. The wave action near the seabed is minimum and nearly horizontal. Another advantage is that buoyancy thereby is utilized to reduce the weight to be handled.

By such off bottom transport the cover may be handing in wires from surface vessels.

Alternativley transportion and/or positioning of the cover is effected by means of a manned or unmanned underwater vehicle as shown in FIGS. 16–17. Diving service can hereby be minimized.

The vehicle consists of buoyance tanks, e.g. in the form of longitudinally extending pipes 29 interconnected by lattice members 30. The pipes 29 are preferably made of plastic so as to obtain maximum buoyance and flexibility. Buoyancy is regulated by pumping water in or out of chambers in the pipes 29. The vehicle may be self-propelled by means of thrusters 31, or to be towed by a surface vessel or a submersible or submarine. For horizontal and vertical maneuvring, the vehicle is provided with thrusters 31 acting in different directions. To decrease the number of thrusters, they may be rotational in one or more planes.

The cover 32 may be held by a system of vacuum clutches 33 sucking directly on the surface of the cover and allowing for simultaneously and instant seizure and release of all of the units. For adjustment to the local bottom configuration of the angle between the symmetrical halves of the cover, the angle can be adjusted by hydraulically operated pistons 34.

Echosounders mounted on the vehicle monitor the distance between the vehicle and seabed and regulate automatically the thrusters to maintain the desired distance. A sonar system including a sonar situation display enables the operator to check the position of the vehicles or the row of interconnected vehicles and thereby to align and navigate the vehicle(s).

If the task is to protect for instance a pipeline, an automatic system for sideways positioning may be used. When the vehicle with the cover has arrived at some point of the pipeline to be protected, as registered via television cameras placed at either end of the vehicle, the positioning system is connected to keep the vehicle centered over or at a certain distance to the side of the pipeline until the site of installation has been reached and the cover positioned. The system includes at either end of the vehicle a pair of magnetometers placed symmetrically on either side of the centerline of the vehicle. Any difference between the degrees to which the pipeline absorbs the magnetic fields of the two magnetometers, is registered and a corresponding corrective current automatically sent to the thrusters to eliminate the corresponding difference between the two distances between the magnetometers and the pipeline.

For installation of smaller units as shown in FIGS. 14—15 the underwater vehicle preferably is supported directly on the seabed by wheels, caterpillars, rollers or runners 35, FIG. 18.

Such small units may be supplied vertially from a surface vessel 36. Appropriately the elements are lowered to the vehicle in a casing 40 guided by lines 41 connecting the surface vessel with the bottom of the casing 39 on the vehicle. The lines 41 may be made of elastic material e.g. rubber, to compensate for the vertical motions of the vessel.

The casing 40 consists of two interchanged parts 42 and 43 that can move horizontally in relation to each other. When the casing 40 is lowered and hits the sloping upper surface of the uppermost element in the casing 39, the part 43 will be pressed away from part 42, whereby the lock 44 preventing the elements from falling out during the lowering of the casing will open up, and the separation of parts 42 and 43 will allow for successive descending of the elements in casing 40 to their respective consoles 54 in casing 39.

The casing 39 on the vehicle carries a stack of elements 46 supported on an inclined plate or beam 47. 47 is inclined to such degree that the lowermost element 48 by it own weight and/or by its coherence to the elements already laid will slide downwards through an opening 49 at the bottom of casing 39. When the rear end of this element with the groove 50, FIG. 7, passes under the tongue 51 of the element 52 immediately above, the tongue 51 will fall down into the groove 50, whereby the element 52 will get free to slide downwards in conjunction with element 48. Hereby all of the elements above will move the same distance downwards.

The upper surface of the plate or beam 47 must have such curve that the element 48 during its downward slide will cause no upward displacement of the element 52. The said curve therefore should be formed by two symmetrical halves forming a peak 53 under the treading point of the element 52. Instead of utilizing gravity for disposing the elements, an endless, horizontal or sloping conveyor belt driven by supporting wheels or caterpillars at the rear end of the vehicle may transport the elements from the casing 39 to the seabed.

To minimize the weight tranferred from the elements above to the lowermost element 48, the lower end of each element may be supported on a console 54. The elements and the surface of each console slope under such angle that only a tiny part of the weight of each element is transferred to the next element below.

The rear end of the vehicle may slide directly on the seabed or be supported on some of the above mentioned kinds of wheels or rollers. If the task is to protect a pipeline, the vehicle is guided along this by guiding members, e.g. rollers, mounted on the vehicle on either side of the pipeline. Preferably the vehicle is self-propelled, e.g. by means of hydraulic motors that are powered from the surface vessel or from a submarine. The vehicle is provided with the same sensor systems as the vehicle for installation of large covers as described above. The magnetometer system enables it to follow very closely the curves of an existing cable to be protected, even if sections of the cable are covered by sand. On such covered sections the elements will be placed on the surface of the sand. If the bottom becomes eroded later on, the elements will sink to the level of the cable.

ĭ claim:

1. A system for depositing and protecting sediment on the floor of a body of water comprising an elongated plate-like structure located on said floor, said plate-like structure including a longitudinally extending center portion spaced above the floor and two longitudinally extending side portions, upper surfaces of said longitudinally extending side portions being in diverging relationship to each other in a direction toward said floor, and means at least partially overlying said longitudinally extending side portions and projecting laterally therebeyond for protecting said plate-like structure from damage due to dragging ship's anchors, fishing gear, and the like.

2. The system as defined in claim 1 wherein the longitudinally extending side portions of said plate-like structure are much steeper than the remainder of said plate-like structure and have such height that the flukes of a ship's anchor can not hook terminal edges thereof.

3. The system as defined in claim 1 including means for movably connecting said protecting means to said longitudinally extending side portions.

4. The system as defined in claim 3 wherein said movable connecting means defines a pivotal connection between said protecting means and said longitudinally extendng side portions.

5. The system as defined in claim 3 wherein said movable connecting means defines a sliding connection between said protecting means and said longitudinally extending side portions.

6. The system as defined in claim 3 wherein said movable connecting means defines a sliding connection between said protecting means and said longitudinally extending side portions, and said slidable connecting means includes openings in said plate-like structure each opening in a direction toward said center portion, and said slidable connecting means further includes elements carried by said protecting means in slidable relationship to said openings.

7. The system as defined in claim 3 wherein said movable connecting means defines a sliding connection between said protecting means and said longitudinally extending side portions, and said slidable connecting means being defined by mating lands and valleys disposed in tranverse relationship to the longitudinal centerline of said plate-like structure.

8. The system as defined in claim 3 wherein said protecting means are a plurality of cover elements disposed along each of said longitudinally extending side portions, and means for articulately connecting together the cover elements along each of said longitudinally extending side portions.

9. The system as defined in claim 3 wherein extending protecting means are a plurality of longitudinally spaced laterally exending elements connected to a longitudinal element at each longitudinal side of said plate-like structure, and the connections between said longitudinal elements and said laterally extending elements are weaker than said connecting means.

10. The system as defined in claim 3 wherein each longitudinally extending side portion includes a foot disposed between said longitudinally extending center portion and a free longitudinal edge of an adjacent longitudinally extending side portion, and said feet project downwardly and away from said longitudinally extending center portion.

11. The system as defined in claim 3 wherein each longitudinally extending side portion includes a foot disposed between said longitudinally exfending center portion and a free longitudinal edge of said adjacent longitudinally extending side portion, said free project downwardly and way from said longitudinally extending center portion, and said skirts are indented.

12. The system as defined in claim 3 wherein said plate-like structure is formed by symmetrical halves pivotally connected to each other along said longitudinally extending center portion.

13. The system as defined in claim 3 wherein said plate-like structure is formed of symmetrical halves pivotally connected to each other along said longitudinally extending center portion, and means for totally separating said halves at a predetermined angle of mutal rotation therebetween.

14. The system as defined in claim 3 wherein said plate-like structure is of a wavy configuration.

15. The system as defined in claim 3 wherein said plate-like structure is of a corrugated configuration decreasing in a direction from said longitudinally extending side portions toward said longitudinally extending center portion.

16. The system as defined in claim 3 wherein said protecting means is formed of cementitious material.

17. The system as defined in claim 3 including another plate-like structure in end-to-end relationship to said first-mentioned plate-like structure, and means pivotally connected said plate-like structures together in end-to-end relationship.

18. The system as defined in claim 17 wherein said last-mentioned connecting means include a pair of transistional elements pivotally connected to each other and to said plate-like structures.

19. The system as defined in claim 18 wherein said transistional elements are triangular as viewed in top plan.

20. The system as defined in claim 12 including another plate-like structure in end-to-end relationship to said first-mentioned plate-like structure, and means pivotally connecting said plate-like structures together in end-to-end relationship.

21. The system as defined in claim 20 wherein said last-mentioned connecting means include a pair of transistional elements pivotally connected to each other and to said plate-like structures.

22. The system as defined in claim 21 wherein said transitional elements are triangular as viewed in top plan.

23. The system as defined in claim 22 wherein said transitional elements are angularly disposed to each other when said halves are coplanar.

* * * * *